United States Patent [19]

Yano et al.

[11] 4,319,930

[45] Mar. 16, 1982

[54] METHOD FOR MULTI-STAGE WASHING

[75] Inventors: Shunji Yano; Tsunehisa Takahashi, both of Sagamihara, Japan

[73] Assignee: Daiwa Can Company, Limited, Tokyo, Japan

[21] Appl. No.: 134,974

[22] Filed: Mar. 28, 1980

[51] Int. Cl.[3] ..... B08B 3/02

[52] U.S. Cl. ..... 134/10; 134/25.4; 134/25.5; 134/26; 134/60; 134/72

[58] Field of Search ..... 134/10, 15, 25.4, 25.5, 134/26, 60, 64 R, 72

[56] References Cited

U.S. PATENT DOCUMENTS

| | | | |
|---|---|---|---|
| 2,541,901 | 2/1951 | Zademach et al. | 134/60 X |
| 2,583,183 | 1/1952 | Marvin et al. | 134/60 X |
| 3,888,693 | 6/1975 | Schevey et al. | 134/10 |
| 3,938,214 | 2/1976 | Hodsen et al. | 134/60 X |
| 3,979,220 | 9/1976 | Ishiyama et al. | 134/10 |
| 4,039,349 | 8/1977 | Kwasnoski et al. | 134/10 |
| 4,062,697 | 12/1977 | Egli et al. | 134/60 X |
| 4,183,115 | 1/1980 | Zakarian | 134/72 X |

*Primary Examiner*—Marc L. Caroff

*Attorney, Agent, or Firm*—Daley & Brandt

[57] ABSTRACT

In a multi-stage washing system comprising a plurality of washing tanks, fresh liquid is applied over a treated material at a front position in the zone of a furthermost tank, whereas in the tanks excluding a nearest tank, washing liquid is pumped from the individual washing tanks in an amount of more than that of the applied fresh liquid and applied over the treated material at a front position in the zones of individual adjacent washing tanks placed after said individual washing tanks in an amount of the applied fresh liquid and a rear position in the zones of said individual washing tanks in the remaining amount.

5 Claims, 2 Drawing Figures

METHOD FOR MULTI-STAGE WASHING

BACKGROUND OF THE INVENTION

This invention relates to an improved method for multi-stage washing surfaces of metallic products such as metal cans to remove a treating liquid from said surfaces.

When bodies of metal cans, for example, two-piece cans known as drawn and ironed cans (DI cans) are to be fabricated, a large amount of a cooling agent is applied over the inside and outside surfaces of side walls of the can in ironing the side walls, and thus it is necessary to remove the cooling agent attached to the surfaces of cans with bottoms after the shaping. Thus, a treating liquid is applied to the cans and successively the cans are washed off the treating liquid.

FIG. 1 shows a typical apparatus for washing off the treating liquid from the surfaces of such metallic products as described above, where an arrow mark Z shows the advancing direction of belt conveyor 5 and metal cans A placed on the belt. Belt 5 and metal cans A together will be hereinfter referred to as "material to be treated", because the treating liquid is applied to and retained on both said cans and said belt. In the advancing direction of the material to be treated there are treating tank 1 filled with treating liquid 11 and washing tanks 2, 3, and 4, each, filled with washing liquids 12, 13 and 14, which contain the treating liquid as a result of washing the resulting treated material, and provided in series in succession to treating tank 1, where tank 4 will be hereinafter referred to as furthermost washing tank in the advancing direction Z, and tank 2 adjacent to treating tank 1 as nearest washing tank.

Numerals 6, 7, 8, and 9 are pumps for pumping the liquids each filled in tanks 1, 2, 3 and 4, numerals 16, 16' 17, 17', 18, 18', 19 and 19' are nozzles for spraying the treating liquid and the washing liquid each pumped up by pumps 6, 7, 8 and 9 over the material to be treated or the treated material in the respective zones of the tanks, numerals 21, 22, 23 and 24 are conduits for passing the liquids by respective pumps 6, 7, 8 and 9 to nozzles 16, 16', 17, 17', 18, 18', 19 and 19', and numeral 20 is a pump for supplying a fresh washing liquid such as fresh water to tank 4 through conduit 25.

In the foregoing apparatus, metal cans A advance together with belt conveyor 5 in the arrow direction Z, and treating liquid 11 is applied over the material to be treated from nozzles 16 and 16' in the zone of tank 1, and the resulting treated material with the treating liquid, that is, cans A and belt 5, is washed with washing liquid 12 in tank 2 in the zone of said tank 2 through nozzles 17 and 17', and the treating liquid on the treated material is diluted. In the zone of tank 3, washing liquid 13 in said tank 3 is sprayed over the treated material through nozles 18 and 18', whereby the treating liquid on the treated material is further diluted. Also in the zone of tank 4, washing liquid 14 is sprayed over the treated material likewise through nozzles 19 and 19', and the treated material is sent to a successive step without any substantial treating liquid thereon.

As is obvious from the foregoing description, the treating liquid falls into washing tanks 2, 3 and 4 from the washed treated material, though the treating liquid is diluted, and the diluted treating liquid, though at a considerably lower concentration than that of the treating liquid 11 in treating tank 1, is entered and retained in the washing liquid in the respective washing tanks. The concentration of the treating liquid in the washing liquids in the respective washing tanks 2, 3 and 4 is highest in washing liquid 12, lower in washing liquid 13, and lowest in washing liquid 14. To prevent an increase in concentration of the treating liquid in the respective washing tanks, fresh liquid such as fresh water is supplied to furthermost tank 4, and washing liquid 14 is supplied in an amount equal to that of the supplied fresh liquid from tank 4 to adjacent tank 3 placed after tank 4 in the advancing direction Z. Furthermore, washing liquid 13 is supplied in an amount equal to that of the supplied fresh liquid from tank 3 to adjacent tank 2 placed after tank 3. Washing liquid 12 is discharged in an amount equal to that of the supplied fresh liquid through conduit 10 from nearest tank 2.

A means for supplying the washing liquid from the individual tanks to tanks placed after said individual tanks can be any appropriate one such as an overflow system, a pumping system, etc.

Volumes and concentrations of the washing liquid in washing tanks 2, 3 and 4 can be kept constant by supplying fresh liquid to the furthermost washing tank and discharging the washing liquid from the nearest tank, and a constant washing effect can be obtained thereby.

Advantages of said multi-stage washing system is to reduce the amount of supplied fresh liquid and attain an equal washing effect to that when the entire washing liquid is stored in a single washing tank and applied to washing, and also to facilitate waste liquid treatment, because only a small amount of washing liquid with a high concentration of the treating liquid, which is equal to the amount of the supplied fresh water is discharged from the system.

SUMMARY OF THE INVENTION

An object of the present invention is to further improve said advantages of the conventional multi-stage washing method, and the present invention is characterized by supplying the fresh liquid over the treated material at a front position, in the sense of the advancing direction of the treated material, in the zone of the furthermost washing tank, pumping the washing liquid from the individual washing tanks exclusing the nearest washing tank in an amount of more than that of the supplied fresh liquid, and spraying the pumped washing liquid over the treated material at a front position in the zones of individual adjacent washing tanks placed after said individual washing tanks in an amount equal to that of the supplied fresh liquid and at a rear position in the zones of said individual washing tanks in the remaining amount.

The present invention provides an improved method for multi-stage washing in a multi-stage washing apparatus comprising a treating tank for treating a material by a treating liquid and at least two washing tanks for washing the resulting treated material by a washing liquid, the washing tanks being arranged in succession to the treating tank in series in the horizontal advancing direction of the treated material, the washing liquid stored in the individual washing tanks being pumped and applied over the treated material within the zones of the individual washing tanks, thereby removing the treating liquid remaining on the treated material, while fresh liquid is supplied to a furthermost washing tank in the advancing direction of the treated material, at the front position in the zone thereof, the washing liquid stored in the individual washing tanks excluding a nearest washing tank adjacent to the treating tank, is supplied in an amount equal to that of the supplied fresh liquid to respective adjacent washing tanks placed after said individual washing tanks, and the washing liquid stored in the nearest washing tank is discharged from itself in an amount equal to that of the supplied fresh liquid, a concentration of the treating liquid diluted and removed from the treated material by washing and entered and retained in the washing liquids being highest in the nearest washing tank, becoming lower from one washing tank to another in the advancing direction of the treated material, and being lowest in the furthermost washing tank, characterized by supplying the fresh liquid over the treated material at a front position, in the sense of the advancing direction of the treated material, in the zone of the furthermost washing tank, pumping the washing liquid from the individual washing tanks excluding the nearest washing tank in an amount of more than that of the supplied fresh liquid, and applying the pumped washing liquid over the treated material at a front position in each of the zones of individual adjacent washing tanks placed after said individual washing tanks in an amount equal to that of the supplied fresh liquid and at a rear position in each of the zones of said individual washing tanks in the remaining amount.

PREFERRED EMBODIMENTS OF THE INVENTION

Figure 1:
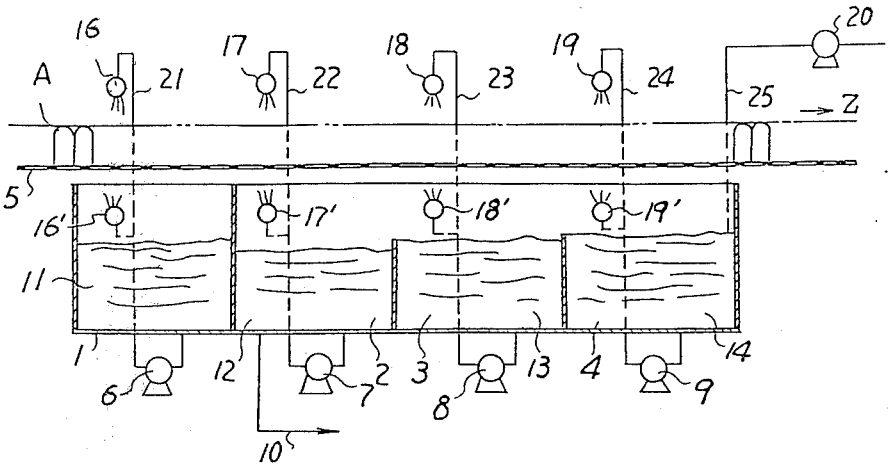
Fig.1 PRIOR ART
FIG. 1 is a schematical view showing an apparatus for carrying out a conventional multi-stage washing method.

The present method will be described in detail below referring to FIG. 2, wherein the same numerals and symbols as in FIG. 1 show the same members as in FIG. 1. That is, numeral 1 is a treating tank, numerals 2, 3 and 4 are washing tanks, numeral 5 is a conveyor, A is metal cans, numerals 6, 7, 8 and 9 each are pumps for pumping treating liquid 11 in tank 1, and pumping liquids 12, 13 and 14 in tanks 2, 3 and 4, numerals 16, 16', 17, 17', 18, 18', 19 and 19' are nozzles for spraying the treating liquid and washing liquid in the zones of tanks 1, 2, 3 and 4 through conduits 21, 22, 23 and 24 by pumps 6, 7, 8 and 9, numeral 20 is a pump for supplying fresh liquid such as water to furthermost washing tank 4 through conduit 25, numeral 10 is a conduit discharging the washing liquid from nearest washing tank 2, and Z is the advancing direction of belt 5 and cans A.

Figure 2:
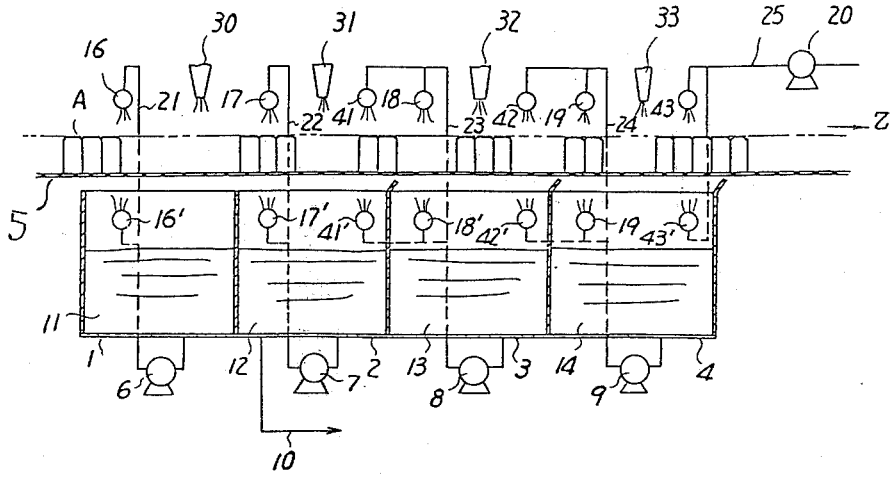
FIG. 2 is a schematical view showing an apparatus for carrying out the present method.

A first difference of the apparatus of FIG. 2 from that of FIG. 1 is that washing liquid conduits 23 and 24 in tanks 3 and 4 are respectively extended to front positions of adjacent washing tanks 2 and 3 placed respectively after the tanks 3 and 4, in the sense of the advancing direction of treated material marked by Z, so as to spray the washing liquid over the treated material in the zones of the adjacent washing tanks 2 and 3 in an amount equal to that of the supplied fresh liquid, and nozzles 41, 41', 42 and 42' are provided at the ends of the extended conduits (of course, no such extended conduit is provided at nearest washing tank 2, because it has no adjacent washing tank). Then, washing liquids 13 and 14 are supplied from washing tanks 3 and 4 to the adjacent washing tanks 2 and 3 placed after the washing tanks 3 and 4 through nozzles 41, 41', 42 and 42' of the extended conduits at the front positions of the adjacent washing tanks 2 and 3 in an amount equal to that of the fresh supplied to furthermost washing tank 4 through conduit 25. While each washing liquid in the individual washing tanks 2, 3 and 4 is also sprayed over the treated material at a rear position of each of the individual washing tanks 2, 3 and 4 in the sense of the advancing direction of the treated material, from nozzles 17, 17', 18, 18', 19 and 19' as in the conventional method. The washing liquid in an amount equal to that of the supplied fresh liquid is discharged from washing tank 2 through conduit 10.

A second difference is that the fresh liquid to furthermost tank 4 is supplied through conduit 25 by spraying over the treated material through nozzles 43 and 43' at the front position in the zone of washing tank 4.

Thus, treating liquid 11 is sprayed over the inside and outside surfaces of metal cans A through nozzles 16 and 16' while metal cans A are advanced together with conveyor belt 5, and then metal cans enter the zone of washing tank 2, where they are washed by spraying washing liquid 12 at a rear position in the washing tank 2 through nozzles 17 and 17'.

The treating liquid remaining on the treated material washed by spraying through nozzles 17 and 17' is diluted to a concentration substantially equal to a concentration of the treating liquid contained in the washing liquid 12 in washing tank 2. Then, the treated material is washed by spraying washing liquid 13 of lower concentration from washing tank 3 through nozzles 41 and 41' at a front position in the washing tank 2, and the treating liquid on the treated material is further diluted to a lower concentration, and enters the zone of washing tank 3. In the zone of washing tank 3, washing liquid 13 of tank 3 is sprayed over the treated material through nozzles 18 and 18' at the rear position of washing tank 3, and then washing liquid 14 from washing tank 4 is sprayed over the treated material at the front position of washing tank 3 through nozzles 42 and 42'. In the zone of washing tank 4, washing liquid 14 of washing tank 4 is sprayed over the treated material at the rear position of washing tank 4 through nozzles 19 and 19', and fresh water is sprayed on the treated material at the front position of washing tank 4 through nozzles 43 and 43'. Then, the thus washed cans are sent to a successive step.

The amounts each of washing liquid sprayed at the front positions in the respective zones of washing tanks 2 and 3 are equal to the amount of fresh liquid supplied to washing tank 4, and the washing liquid is discharged from washing tank 2 in an amount equal to that of the supplied fresh liquid. The discharging liquid is reused after removing the treating liquid therefrom.

In the case of the apparatus of FIG. 1, the washing liquid of the respective washing tanks is sprayed over the treated material only within the zones of the respective washing tanks, and thus the treated material is never washed to a concentration below that of the sprayed washing liquid of the respective washing tanks. For example, suppose that a concentration of the treating liquid attached to the treated material be Y when the treated material is moved from the zone of washing tank 2 to that of washing tank 3, and a concentration of washing liquid of washing tank 2 be X. Such a relation as $Y \approx X$ is established.

In the present method, on the other hand, the treated material enters the adjacent next tank after washed with washing liquid having a lower concentration coming from the adjacent next tank, and thus a concentration of the treating liquid on the treated material is lower than the concentration in the washing liquid in the tank through whose zone the treated material is passing. That is, the treated material with the treating liquid at a lower concentration enters the successive washing tank. Suppose that a concentration of the treating liquid on the treated material entering washing tank 3 by Y', and a concentration in washing tank 2 be X'. Such a relation as $Y' < X'$ is established.

In order to give the same washing effect to both the apparatus of FIG. 1 and that of FIG. 2, concentration of the treating liquid on the treated material must be equal between the apparatus of FIG. 1 and that of FIG. 2 in the movement of the treated material into the zone of the adjacent next washing tank, that is, when $Y = Y'$, such a relation as $X < X'$ is established. And in order to make said both apparatuses maintain the same concentration, the amount of the treating liquid discharged from washing tank 2 must be equal between both apparatuses. Thus the amount of the washing liquid discharged at the higher concentration X' can be smaller than that discharged at the lower concentration X, and consequently discharged liquid treatment can be much facilitated. Since the amount of discharged washing liquid is equal to the amount of supplied fresh liquid, as described above, the amount of fresh liquid can be also smaller in the apparatus of FIG. 2 than in the apparatus of FIG. 1 based on the conventional method, and thus can be much saved.

Specific embodiments of the present method will be given below in contrast in the conventional method.

In order to make a concentration of treating liquid attached to a can after three-stage water washing when a concentration of treating liquid in treating tank 1 is 1%, and an amount of the attached treating liquid moving together with cans A and conveyor belt 5 per minute is 2.7 l, a concentration of treating liquid in washing tank 2 must be 0.41%, a concentration of treating liquid in washing tank 3 0.10%, and a concentration of treating liquid in washing tank 4 0.02%, while fresh water is supplied to washing tank 4 at a rate of 5.86 l/min. according to the present method. On the other hand, in the conventional method, a concentration of treating liquid in washing tank 2 must be 0.23%, a concentration of treating liquid in washing tank 3 0.05%, and a concentration of treating liquid in washing tank 4 0.01%, while fresh water must be supplied to washing tank 4 at a rate of 11.4 l/min. In these two methods, concentrations of treating liquid can be kept constant in the respective tanks at said values.

It is seen from the foregoing that the present method can save about 50% of the amount of fresh liquid to be supplied, as compared with the conventional method.

In FIG. 2, numerals 30, 31, 32 and 33 are compressed air injection nozzles for blowing off the attached liquid on the treated material, and are each provided at a front position in the zone of treating tank 1, and between proper nozzles 17 and 17' and extended nozzles 41 and 41' in washing tank 2, between proper nozzles 18 and 18' and extended nozzles 42 and 42' in washing tank 3, and between proper nozzles 19 and 19' and extended nozzles 43 and 43'. For example, attached treating liquid 11 can be partly blown off by compressed air from nozzle 30 before the treated material is moved from treating tank 1 to washing tank 2, and the amount of the attached treating liquid is correspondingly reduced. This means that washing in successive washing tank 2 is much facilitated.

In the foregoing description, three washing tanks are used, but at least two washing tanks can satisfy the present method with a good effect. That is, much more washing tanks can be used in the present invention.

Pair of nozzles provided above and below the treated material can be replaced with single nozzles provided above or below the treated material, and number of the nozzles is not restricted to one. Compressed air injection nozzles can be provided above or below, or both above and below the treated material.

Fresh liquid can be partly sparyed in the zone of washing tank 2 or 3 in place of sparying all the amount of it in the zone of furthermost tank 4.

It will be apparent that various changes in form and details can be made to the method of the invention without departing from the spirit and scope thereof, the forms hereinbefore described being merely preferred embodiments thereof.

What is claimed is:

1. In a method for multi-stage washing wherein a treating tank is provided containing a treating liquid which is used for treating a material, wherein such treated material is advanced in a preselected direction from said treating tank above a plurality of washing tanks, each washing tank containing a washing liquid, the washing tanks being arranged in succession to the treating tank in series in such preselected advancing direction of the treated material, washing liquid being independently pumped from each of said washing tanks and sprayed against the treated material within a respective zone of registry of each of said washing tanks with said preselected advancing direction of the treated material at a first position in each such zone, fresh washing liquid being supplied to one of said washing tanks, the improvement wherein washing liquid is sprayed against the treated material also at a second position in at least one such zone, the washing liquid applied to the treated material at such second position having a lower concentration of treating liquid therein than the washing liquid applied to the treated material at said first position and being solely derived from a washing tank adjacent the washing tank in registry with said at least one such zone.

2. An improved method according to claim 1, wherein the fresh liquid is water.

3. The invention claimed in claim 1 wherein said fresh washing liquid is supplied to the washing tank last successive in said preselected advancing direction of the treated material, the concentrations of the treating liquid in such washing liquid being lower from one such washing tank to another in said preselected advancing direction of the treated material.

4. The invention claimed in claim 3 wherein washing liquid is withdrawn from one such washing tank in an amount equal to the amount of fresh washing liquid supplied to the washing tank last successive in said preselected advancing direction of the treated material.

5. The invention claimed in claim 4 wherein said one such washing tank is disposed immediately adjacent said treating material tank in said preselected advancing direction of the treated material.

* * * * *